US005833495A

United States Patent [19]

Ito

[11] Patent Number: 5,833,495

[45] Date of Patent: Nov. 10, 1998

[54] PLUG TYPE CABLE CONNECTOR

[75] Inventor: Tomoaki Ito, Machida, Japan

[73] Assignee: Molex Incorporated, Lisle, Ill.

[21] Appl. No.: 769,722

[22] Filed: Dec. 18, 1996

[30] Foreign Application Priority Data

Dec. 29, 1995 [JP] Japan ..... 7-353376

[51] Int. Cl.[6] ..... H01R 9/03

[52] U.S. Cl. ..... 439/610

[58] Field of Search ..... 439/607–610, 439/108, 98

[56] References Cited

U.S. PATENT DOCUMENTS

| | | | |
|---|---|---|---|
| 3,945,708 | 3/1976 | Griffin | 339/189 R |
| 4,193,655 | 3/1980 | Herrmann, Jr. | 339/31 R |
| 4,449,778 | 5/1984 | Lane | 439/610 |
| 4,685,758 | 8/1987 | Yoshida | 439/606 |
| 4,838,808 | 6/1989 | Fujiura | 439/610 |
| 5,338,227 | 8/1994 | Nakamura | 439/610 |
| 5,451,717 | 9/1995 | Itou | 174/77 R |
| 5,618,190 | 4/1997 | Masuda et al. | 439/610 |
| 5,618,208 | 4/1997 | Crouse et al. | 439/610 |
| 5,683,270 | 11/1997 | Warislohner | 439/610 |

*Primary Examiner*—Hien Vu
*Attorney, Agent, or Firm*—Stephen Z. Weiss

[57] ABSTRACT

An electrical connector includes a dielectric body mounting a plurality of terminals adapted for terminating the conductors of an electrical cable extending rearwardly from the body. A conductive shield casing substantially surrounds portions of the dielectric body and at least the terminations between the terminals and the conductors. A dielectric outer sheath substantially surrounds at least a rear portion of the conductive shield casing. A cap is fitted about the cable and covers substantially entirely the rear periphery of the dielectric outer sheath. A dielectric boot is overmolded about the cable, the cap and the rear periphery of the outer sheath. The cap prevents ingress of any overmolding material into the sheath and the interior of the connector.

11 Claims, 12 Drawing Sheets

PLUG TYPE CABLE CONNECTOR

FIELD OF THE INVENTION

This invention generally relates to the art of electrical connectors and a method of making the same.

BACKGROUND OF THE INVENTION

Generally, an electrical connector typically includes a plurality of terminals which are connected to the conductors of an electrical cable. The terminals usually are mounted in a dielectric body. The connector may include a conductive shield casing for shielding the terminations of the terminals and the conductors from electrical interference. The overall connector may be encased within an outer sheath of insulating material. Still further, a dielectric boot often is positioned about the rear of the connector and a portion of the projecting cable. The boot may be applied by an overmolding process and, in part, functions as a strain relief means for the cable.

The fabrication of an electrical connector as described above often is a detailed and inherently inefficient process. The cable initially must be prepared by removing a distal section of its outer cladding and usually stripping insulation from around the conductors to expose the conductors for termination to the terminals which, themselves, must be mounted in the dielectric body. The body must be covered by the shield casing, and the outer sheath must be assembled about the casing before the rear boot is overmolded about the preassembled subassembly. The outer sheath may be formed in two halves and preassembled by a resin material. The outer sheath must be held onto the shield casing during the overmolding process, and means must be provided to prevent the overmolding material from entering the interior connecting cavity. Still further, each two conductors of the cable typically are twisted to prevent leakage of signals to adjacent conductors, and the untwisted length must be shortened as much as possible. All of these processing parameters are difficult to achieve in an efficient manner, and incomplete or defective connectors correspondingly are produced. The present invention is directed to solving this myriad of problems by an efficient connector and method of making the same.

SUMMARY OF THE INVENTION

An object, therefore, of the invention is to provide a new and improved electrical connector of the character described, along with an improved method of making the connector.

In the exemplary embodiment of the invention, the electrical connector includes a dielectric body mounting a plurality of terminals adapted for terminating the conductors of an electrical cable extending rearwardly from the body. A conductive shield casing substantially surrounds portions of the dielectric body and at least the terminations between the terminals and the conductors. The dielectric outer sheath substantially surrounds at least a rear end of the conductive shield casing. A cap is fitted about the cable and covers substantially entirely the rear periphery of the dielectric outer sheath. A dielectric boot is overmolded about the cable, the cap and the rear periphery of the outer sheath. Therefore, the cap prevents ingress of any overmolding material into the sheath and the interior of the connector.

As disclosed herein, the dielectric outer sheath is generally cylindrical and extends rearwardly beyond the conductive shield casing and over a front end portion of the cable.

A front end of the dielectric body, surrounded by a front end of the conductive shield casing, projects outwardly beyond a front end of the dielectric outer sheath. The cap is fabricated of dielectric material and includes a circumferential groove for receiving a peripheral edge of the dielectric outer sheath.

Another feature of the invention includes the provision of latch means operatively associated between the conductive shield casing and the dielectric outer sheath to hold the sheath on the casing during the overmolding process. As disclosed herein, the latch means includes a resilient snap-latch on the dielectric outer sheath engageable with a latch shoulder on the conductive shield casing. Finally, the conductive shield casing includes a portion extending rearwardly for clamping onto a cable shield at a front end of the cable.

The invention also is directed to a method of fabricating the electrical connector as outlined above.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figure 1:
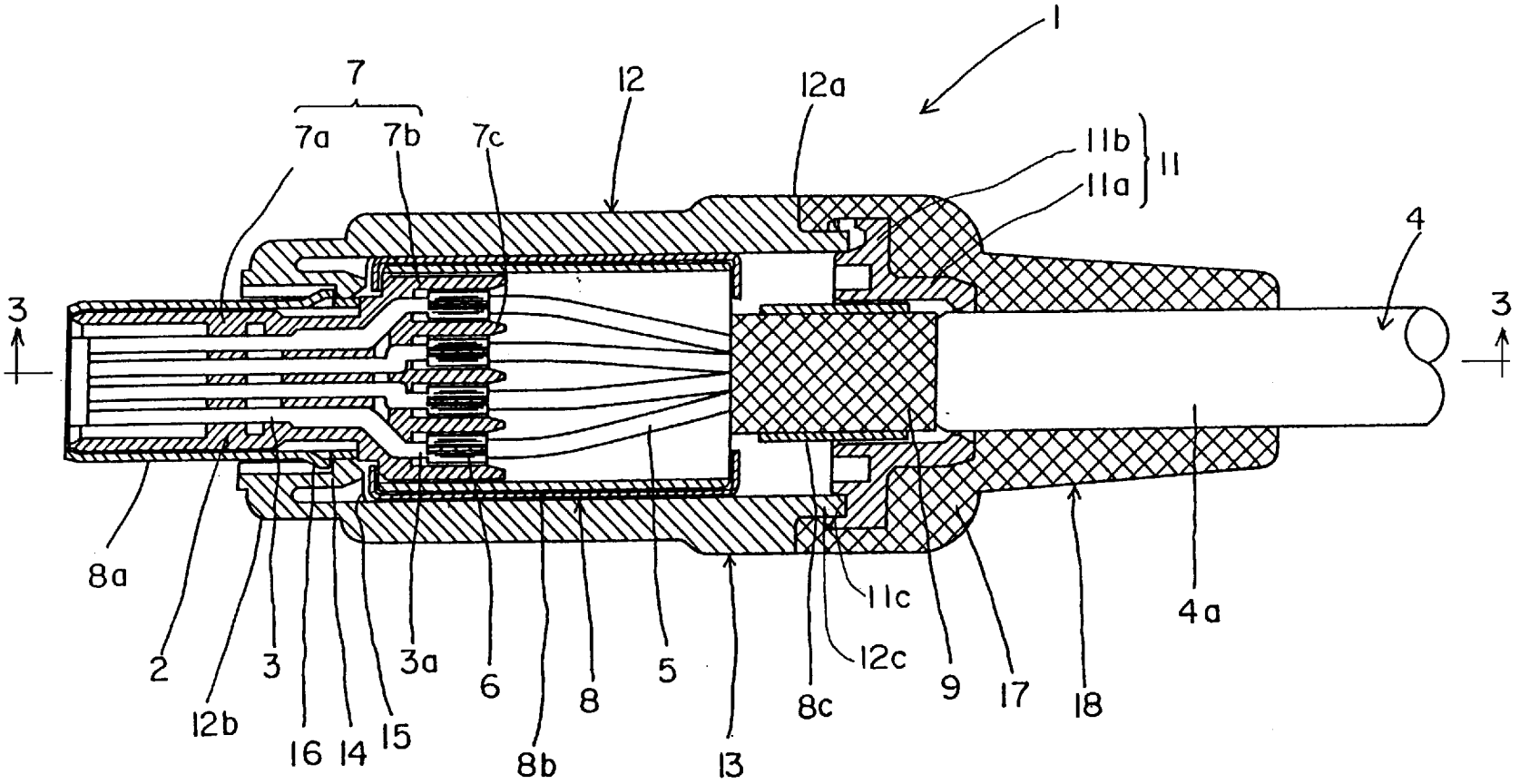
FIG. 1 is a longitudinal section through the electrical connector embodying the concepts of the invention.
Figure 2:
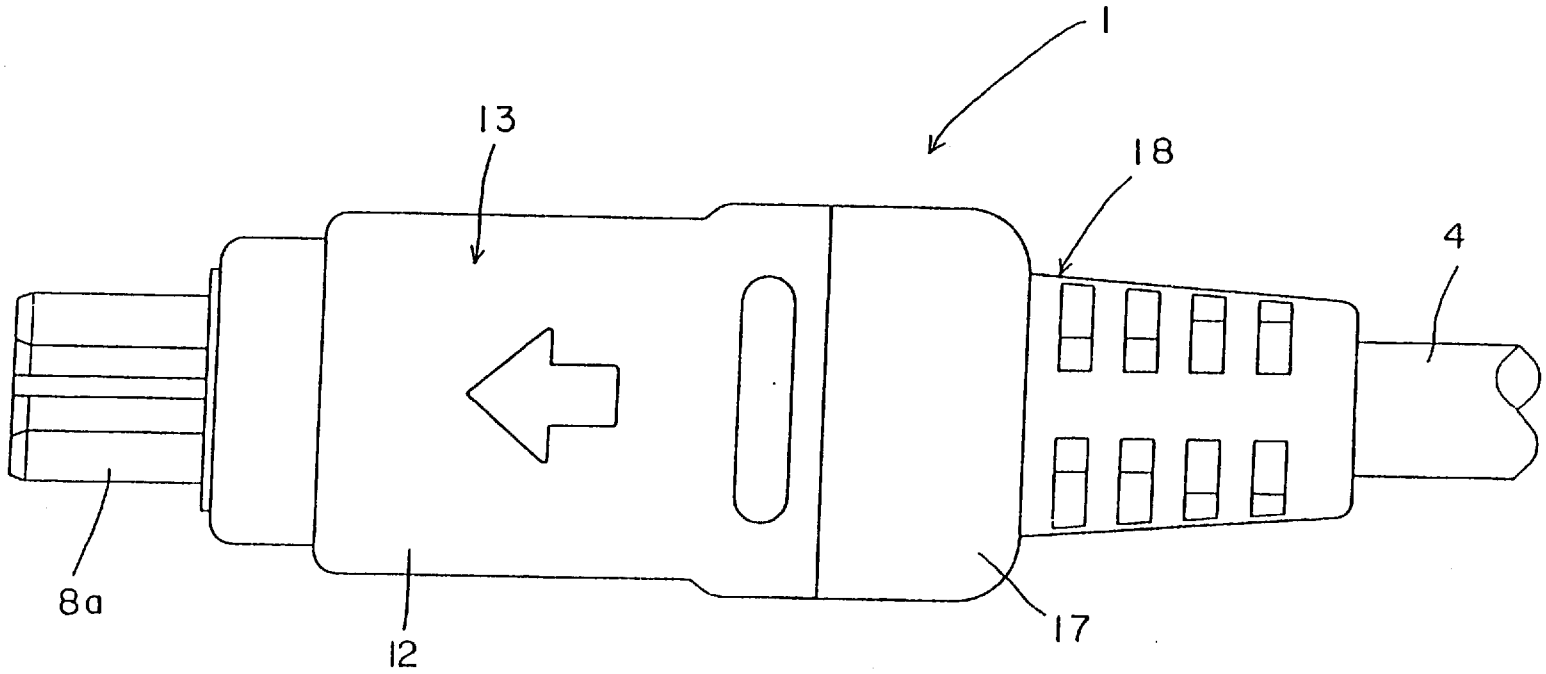
FIG. 2 is a top plan view of the connector.

Referring to the drawings in greater detail, and first to FIGS. 1–4, the invention is illustrated as embodied in a plug-type electrical connector, generally designated 1, which includes a plug body 2 that can be mated, for example, with a receptacle connector of an appropriate appliance, such as a video camera body or the like. A plurality of terminals 3 are mounted in plug body 2 and have tails 3*a* soldered to the stripped ends 6 of conductors 5 at the forward end 4*a* of an electrical cable, generally designated 4. Plug body 2 forms an insulating housing 7 having a front head portion 7*a* and an enlarged tail portion 7*b*. Therefore, the lateral distance between the conductors is increased by enlarging the tail portion. The conductors are separated by partitions 7*c* in tail portion 7*b* of the plug body. This facilitates soldering the conductor ends 6 to terminal tails 3*a* and eliminates the necessity of covering the terminal-to-conductor connections.

Figure 3:
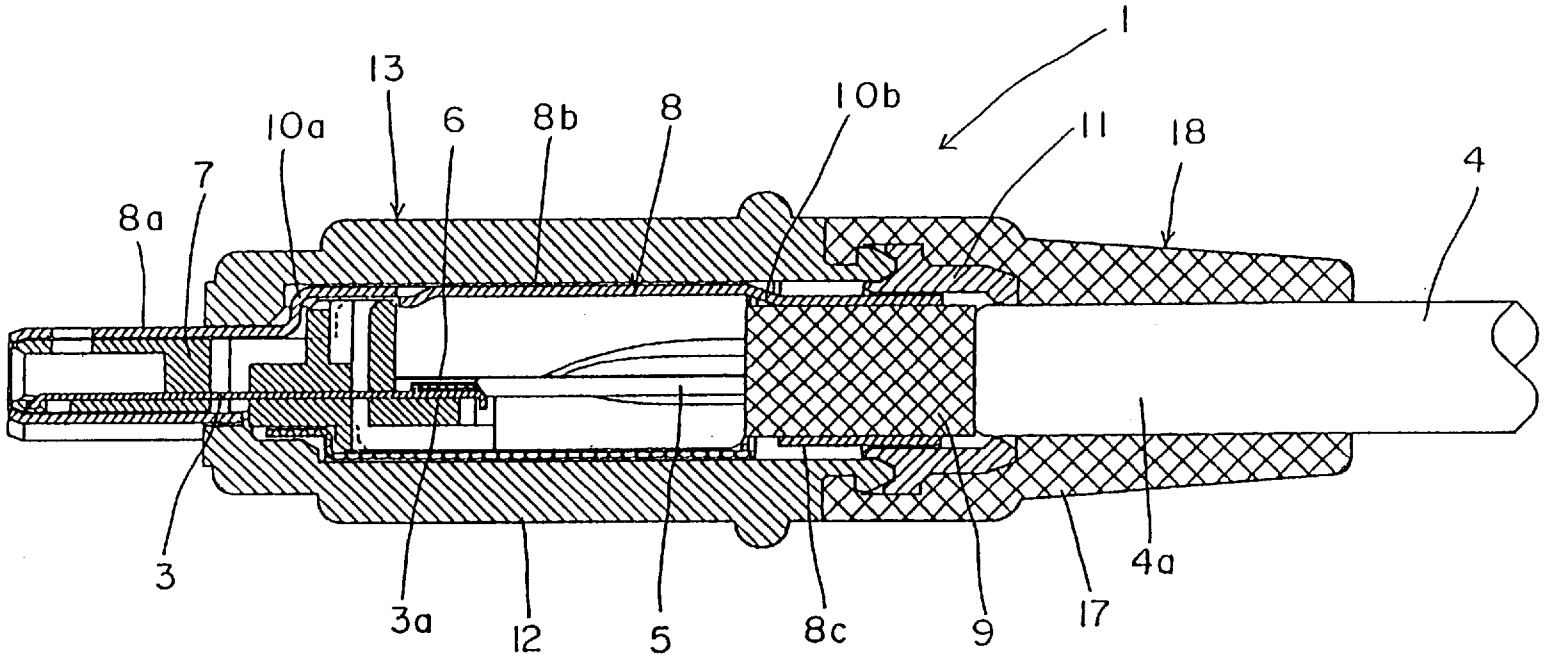
FIG. 3 is a longitudinal section taken generally along line 3—3 of FIG. 1.
Figure 4:
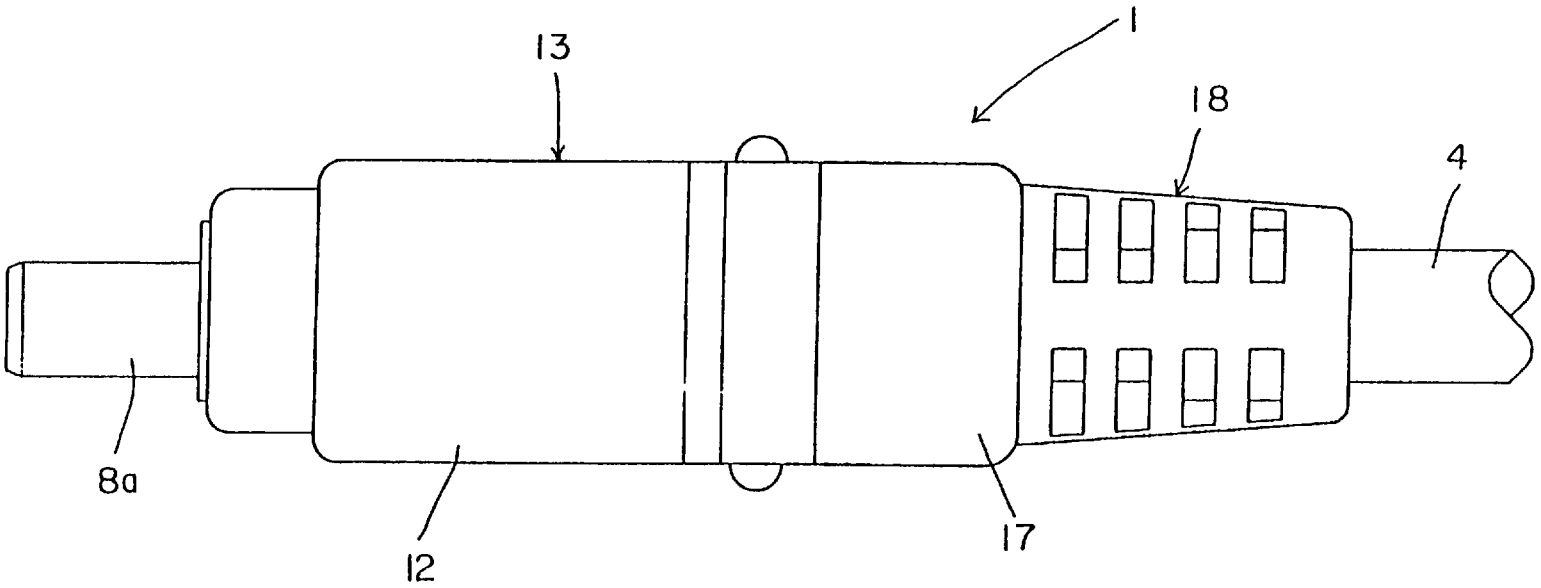
FIG. 4 is a bottom plan view of the connector.

A shield casing, generally designated 8, of conductive sheet metal material substantially surrounds plug body 2 and cable conductors 5. Specifically, the shield casing includes a front head shielding section 8*a* covering head portion 7*a* of the plug body, an intermediate shielding section 8*b* covering the enlarged tail portion 7*b* of the plug body and conductors 5 of cable 4, and a rear or tail shielding section 8*c* covering the end of cable 4. The box-like intermediate shielding section 8*b* includes upper and lower halves. The cylindrical tail shielding section 8*c* provides a crimping section for clamping around the cable end. The inner shield of the cable is folded back to cover the end of the cable, and an electrically conductive tape 9 is wound about the folded-back shield. Shield casing 8 is connected to plug body 2 and the cable end by crimping tail shielding section 8*c* about the taped end of the cable. As seen in FIG. 3, head shielding section 8*a*, intermediate shielding section 8*b* and tail shielding section 8*c* are integrally connected by joint portions 10*a* and 10*b*.

A cylindrical cap 11 is fitted onto cable end 4*a* and includes a hollow cylinder portion 11*a* and an annular collar 11*b* integral with the hollow cylinder. Preferably, the cap is fabricated of dielectric material such as plastic or the like. A prefabricated cylindrical outer sheath 12 of dielectric material is mounted on plug body 12 about conductive shield 8. A tail end of sheath 12 is engaged with the annular collar 11*b* of cap 11 by positioning a rear peripheral edge 12*c* of the sheath in a circumferential groove 11*c* of the cap. Therefore, prefabricated sheath 12 covers a longitudinal portion of the connector from a mid-area of plug body 2 close to the end of tail shielding section 8*c* of shield casing 8. A forward section 12*b* of sheet 12 has resilient snap-latches 14 on the inside thereof for latching behind latch shoulders 16 of the head shielding section 8*a* of shield casing 8. Therefore, the dielectric outer sheath can be mounted on the shield casing and latched thereto during a subsequent overmolding process, while allowing cap 11 to be correctly positioned at the rear of the outer sheath.

A dielectric boot, generally designated 18, is overmolded about cable end 4*a* and includes a forward cylindrical portion 17 overmolded about cap 11 and peripheral edge 12*c* of outer sheath 12. It can be seen that the outer surface of the cylindrical portion 17 of the boot is generally flush with the rear end 12*a* of outer sheath 12 so that the boot substantially forms a continuation of the outer sheath. The boot provides strain relief for the cable. Cap 11 prevents ingress of any overmolding material into the inside of the outer sheath, i.e. to the interior of the electrical connector around the shield and the terminals.

Figure 5:
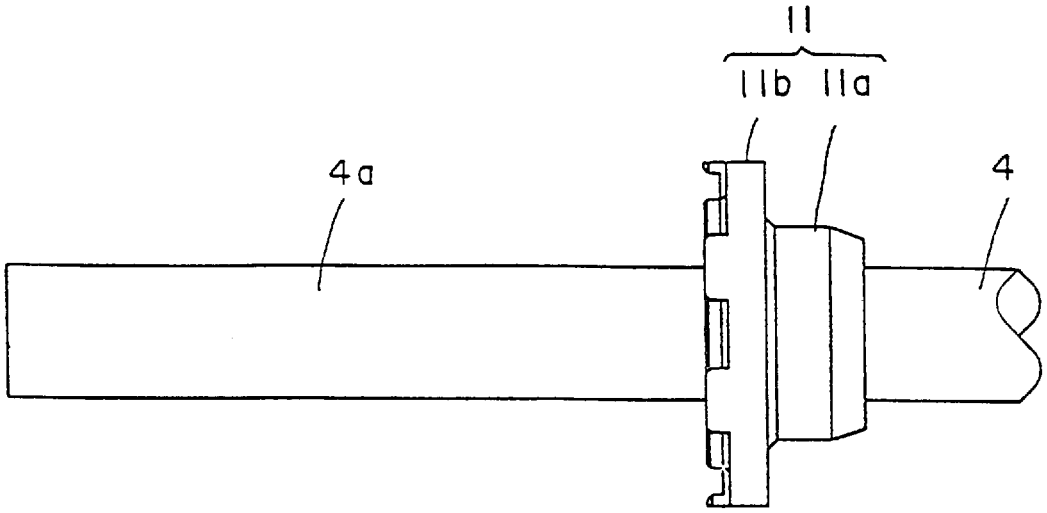
FIG. 5 is a view of the first step in fabricating the connector, including positioning the cap over the electrical cable.
Figure 6:
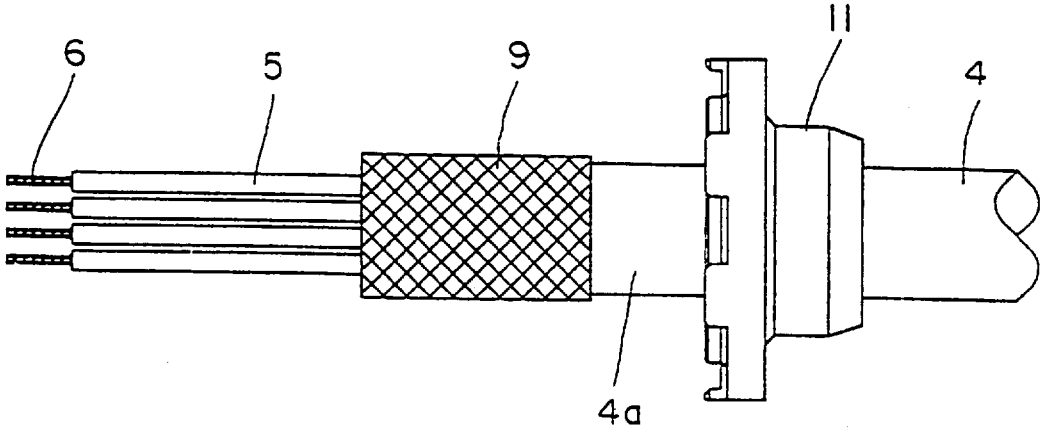
FIG. 6 is a view similar to that of FIG. 5, but showing the cable prepared for termination.

FIGS. 5–13 illustrate the method of the invention in fabricating electrical connector 1. First, cap 11 is threaded onto cable end 4*a* of cable 4 as shown in FIG. 5. The cable then is treated or prepared as shown in FIG. 6. Specifically, the conventional outer insulating cladding or jacket of the cable is removed at the distal end thereof to expose conductors 5. The insulation about the individual conductors is stripped to expose conductor ends 6. The inner shield of the cable is folded back over a distal end of the outer cladding of the cable, and an electrically conductive tape 9 is wrapped about the folded-back shield as shown in FIG. 6.

Figure 7:
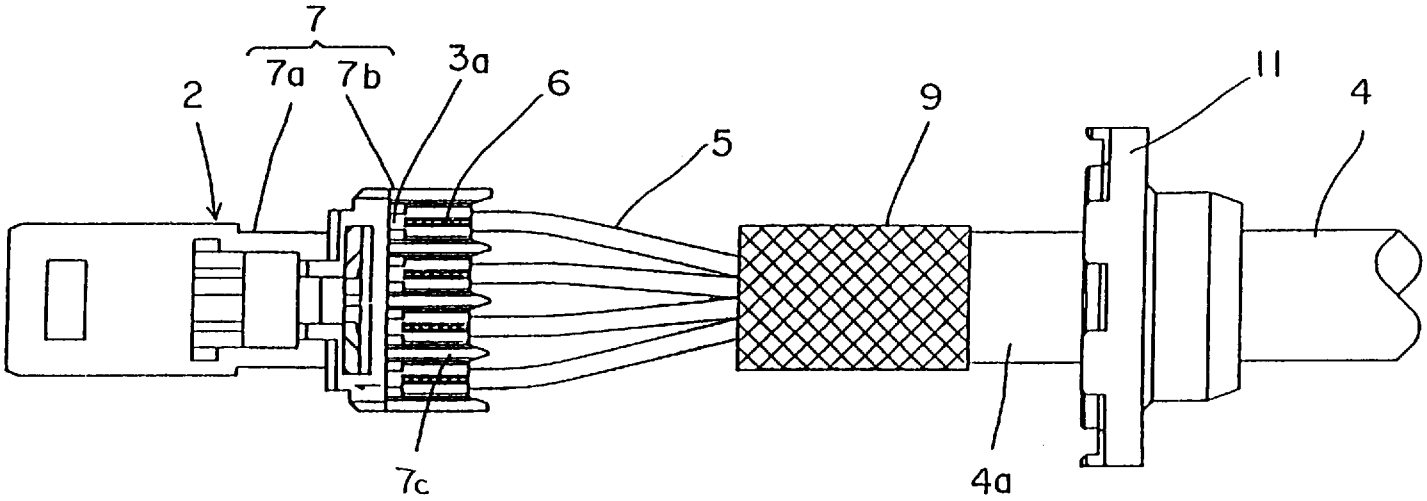
FIG. 7 is a view of the next step of terminating the cable conductors to terminals in the body.

FIG. 7 shows the next step wherein the conductors are terminated to the terminals within plug body 2. Specifically, the stripped ends 6 of conductors 5 are soldered to tails 3*a* of the terminals.

Figure 8:
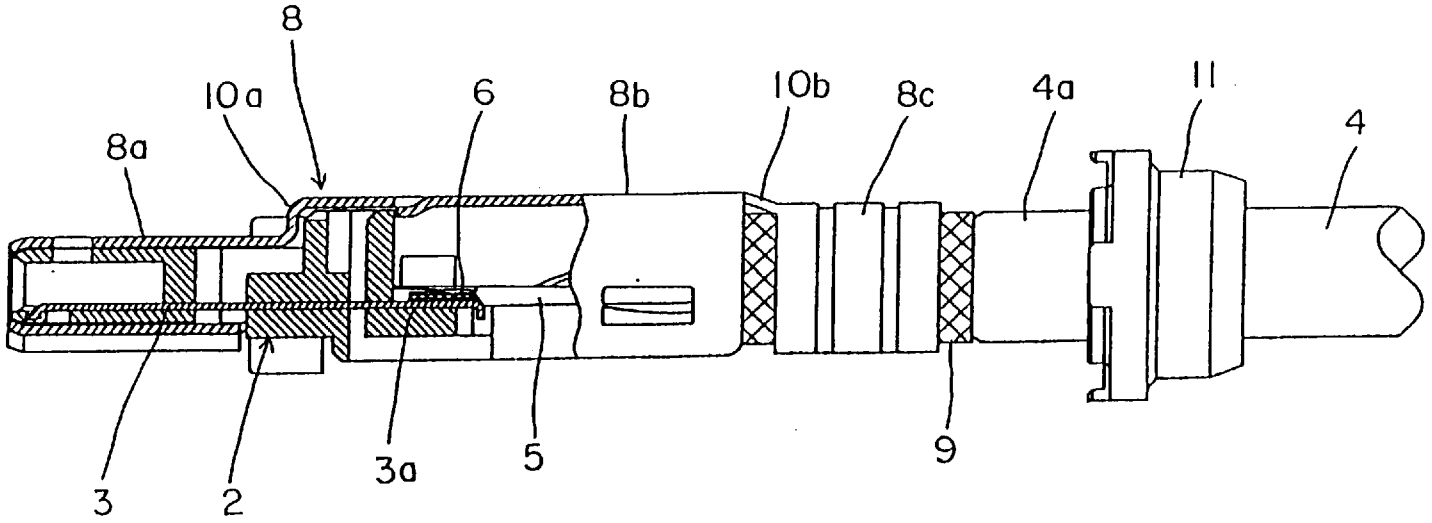
FIG. 8 shows the conductive shield casing mounted to the subassembly of FIG. 7.
Figure 9:
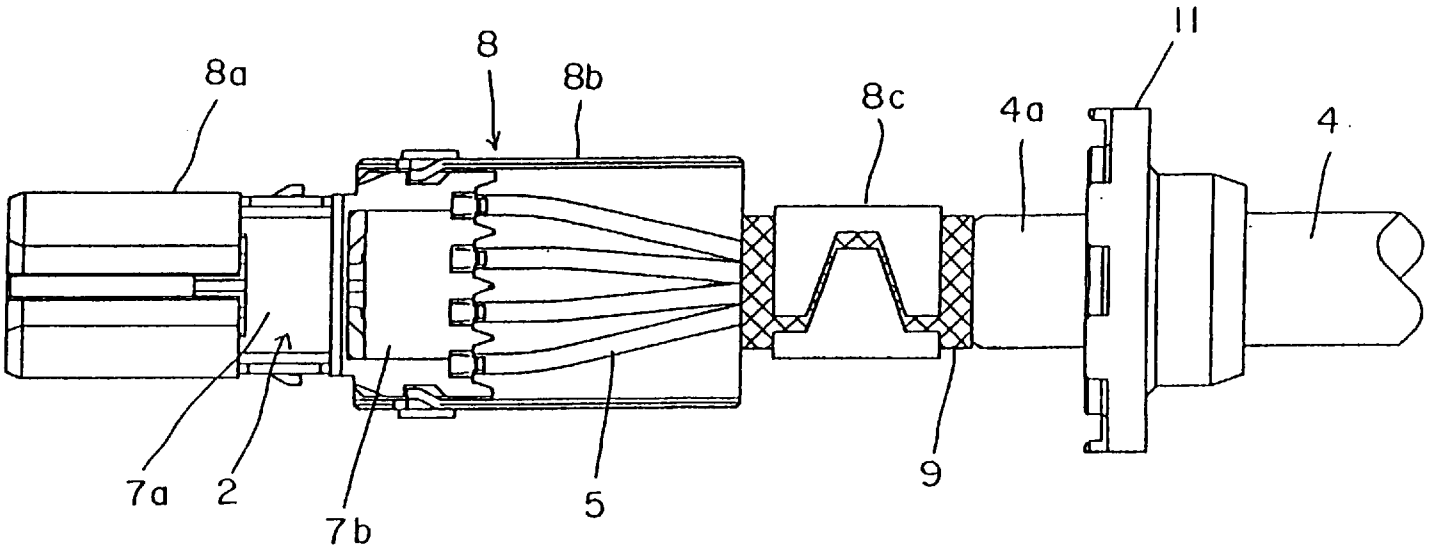
FIG. 9 is a view similar to that of FIG. 8, at a right-angle thereto.
Figure 10:
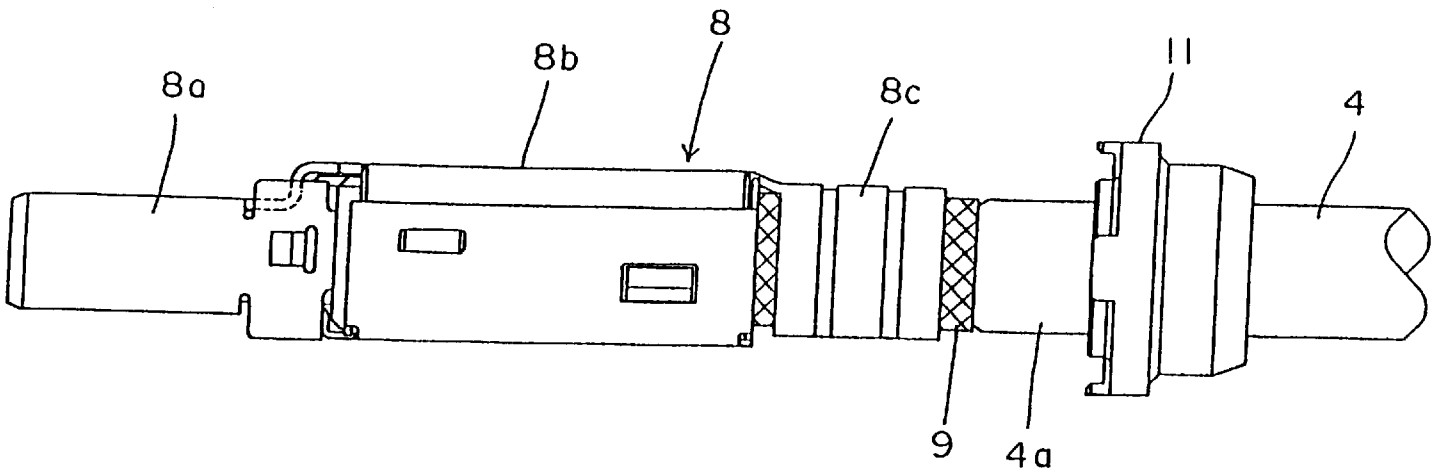
FIG. 10 is a view similar to that of FIG. 8, with the lower part of the shield casing assembled.
Figure 11:
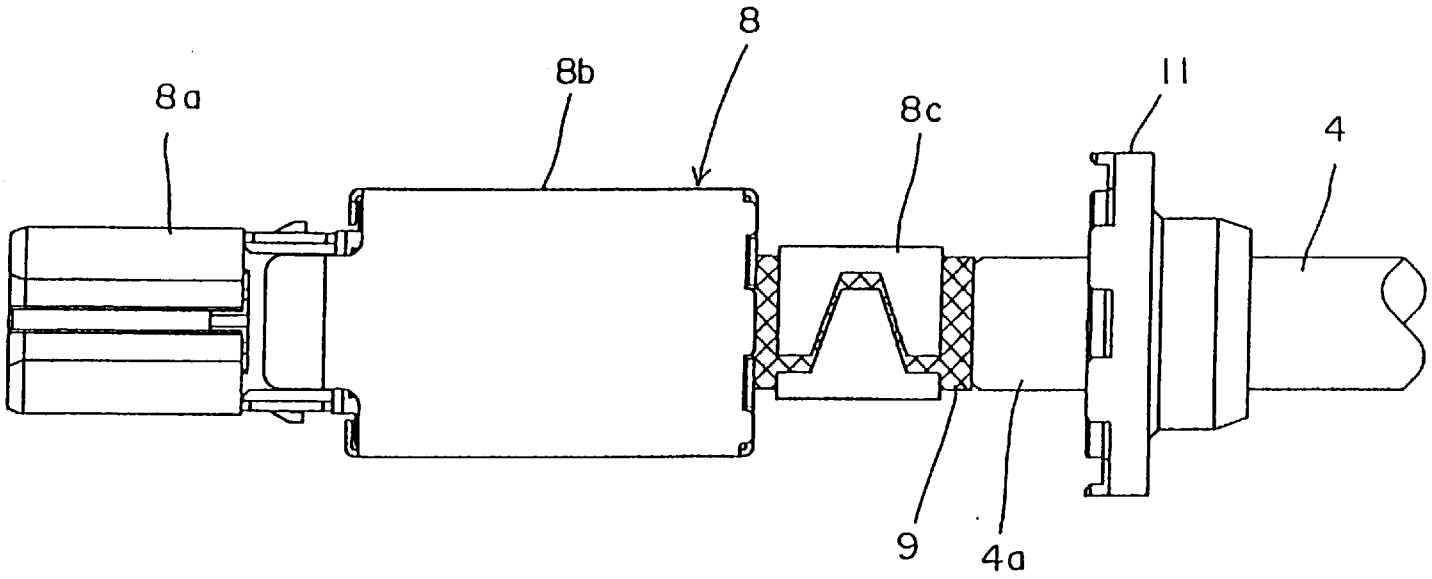
FIG. 11 is a bottom plan view of the subassembly of FIG. 10.

Referring to FIGS. 8–11, conductive shield casing 8 is mounted to a longitudinal portion of the connector extending from plug body 2 to electrically conductive tape 9. The intermediate box-like section 8*b* of the shield casing includes upper and lower halves. The upper half is connected to head and tail sections 8*a* and 8*c*, respectively, by joint portions 10*a* and 10*b*. Referring to FIGS. 8 and 9, the upper half of the intermediate casing 8*b* is positioned, and tail section 8*c* is crimped about the taped end of the cable. Thereafter, and referring to FIGS. 10 and 11, the lower half of intermediate section 8*b* is positioned, thus enclosing the conductors and the terminations of the conductors with the terminals.

Figure 12:
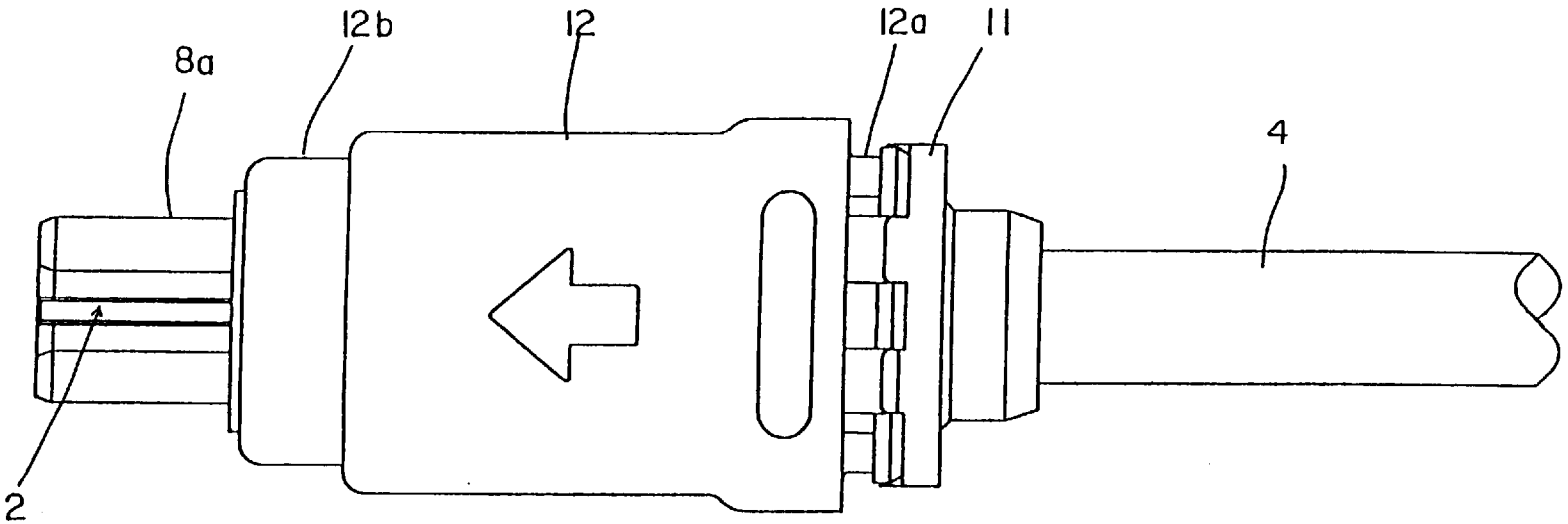
FIG. 12 is a top plan view of the subassembly of FIGS. 10 and 11, but with the dielectric outer sheath mounted thereto.
Figure 13:
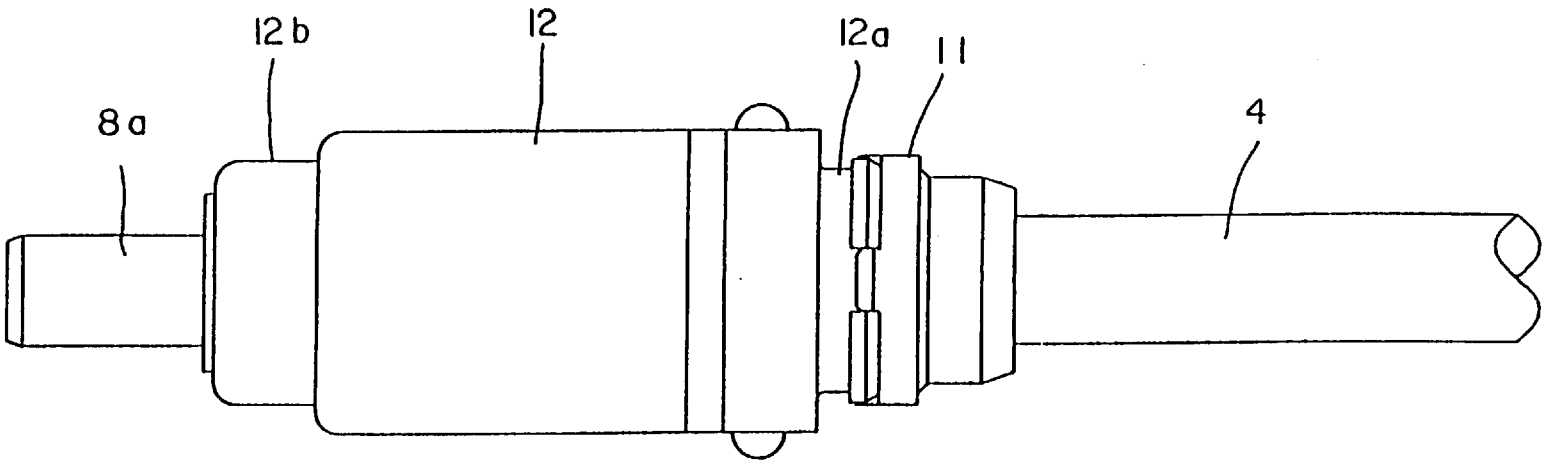
FIG. 13 is a bottom plan view of the assembly of FIG. 12.

The next step of applying cylindrical sheath 12 is shown in FIGS. 12 and 13. It should be understood at this point that, although the sheath is generally rectangular in cross-section, it is considered cylindrical in a generic sense. The sheath is assembled by positioning the sheath in a rearward direction over the front end of plug body 2 until snap-latches 14 snappingly latch behind latch shoulders 16 as shown in FIG. 1 and as described above. Actually, snap-latches 14 are sandwiched between latch shoulders 16 and a step-like bent portion 15 of shield casing 8. Once the sheath is properly positioned and latched, cap 11 is moved forwardly to engage and seal the rear peripheral edge of the sheath and to close the interior cavity of the connector.

Lastly, dielectric boot 18 is overmolded about cable end 4*a*, about cap 11 and about the rear periphery of outer sheath 12 as seen best in FIG. 1. During the overmolding process, latch means 14 and 16 hold outer sheath 12 on shield casing 8, and cap 11 prevents the ingress of any overmolding material into the sheath and the interior of the connector.

As may be understood from the above, electrical connector 1 has no parts that must be precisely positioned onto cable 4 or cable end 4*a* and, therefore, the manufacturing efficiency will be increased, substantially reducing the possibility of making incomplete or defective products. The longitudinal section of cylindrical sheath 12 covering a substantial length of shield casing 8 is a prefabricated cylindrical hollow body which requires no complicated coupling means between the shield casing and the sheath other than the simple snap-latch means. Accordingly, the shield casing can be reduced to a simple structure permitting enlarging the inner space of the connector. Thus, tail 3*a* of the terminals are arranged laterally at increased pitch. The terminal tails are separated by partitions 7*c*, thereby eliminating the necessity of covering the tail and conductor connections with an insulating material such as tubes. The partitions facilitate the soldering process, and the tail and conductor terminations are reduced to a straight, shortest length. Thus, the tail and conductor terminations are free of wavy elongations as would result from insulating the tail and conductor terminations by tubes. Although conductors 5 are shown as being straight wires in FIGS. 1, 3, 6, 7, 8 and 9, simply for simplicity purposes in the drawings, each two conductors are, in fact, twisted to prevent signal interference between adjacent conductors 5. Only the conductors of short length close to terminal tails 3*a* in plug body 2 are untwisted and, therefore, no adverse effect can be caused because little or no interference would result at the untwisted location.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. An electrical connector, comprising:

a dielectric body having a plurality of terminals, a portion of each terminal connected to a respective conductor of an electrical cable extending rearwardly from the body;

a conductive shield casing substantially surrounding the dielectric body and said portion of each terminal;

a dielectric outer sheath with an inner cavity having a rear open end, the conductive shield casing with the dielectric body located therewithin, slidably received through the rear open end, the outer sheath substantially surrounding at least a rear portion of the conductive shield casing;

a cap fitted about the cable, covering substantially entirely the rear periphery of the dielectric outer sheath and sealing the rear open end of the cavity;

a dielectric boot overmolded about the cable, the cap and the rear periphery of the outer sheath, whereby the cap prevents ingress of any overmolding material into the sheath and the interior of the connector; and latch means, including a resilient snap-latch on the dielectric outer sheath engageable with a latch shoulder on the conductive shield casing, operatively associated between the conductive shield casing and the dielectric outer sheath when the conductive shield casing is slid into a final position to hold the sheath on the casing when the dielectric boot is overmolded about the cable.

2. The electrical connector of claim 1 wherein said dielectric outer sheath is generally cylindrical and extends rearwardly beyond the conductive shield casing and over a front end portion of the cable.

3. The electrical connector of claim 1 wherein a front end of the dielectric body, surrounded by a front end of the conductive shield casing, projects outwardly beyond a front end of the dielectric outer sheath.

4. The electrical connector of claim 1 wherein said cap includes a circumferential groove for receiving a peripheral edge of the dielectric outer sheath.

5. The electrical connector of claim 1 wherein said cap is fabricated of dielectric material.

6. The electrical connector of claim 1 wherein said conductive shield casing includes a portion extending rearwardly for clamping onto a shield at a front end of the cable.

7. An electrical connector, comprising:

a dielectric body having a plurality of terminals, a portion of each terminal connected to a respective conductor of an electrical cable extending rearwardly from the body;

a conductive shield casing substantially surrounding the dielectric body and said portion of each terminal;

a dielectric outer sheath with an inner cavity having a rear open end, the conductive shield casing with the dielectric body located therewithin, slidably received through the rear open end, and the outer sheath substantially surrounding at least a rear portion of the conductive shield casing, the sheath being generally cylindrical and extending rearwardly beyond the conductive shield casing and over a front end portion of the cable;

a front end of the dielectric body, surrounded by a front end of the conductive shield casing, projecting outwardly beyond a front end of the dielectric outer sheath;

a dielectric cap fitted about the cable and covering substantially entirely the rear periphery of the dielectric outer sheath and sealing the rear open end of the cavity;

a dielectric cap boot overmolded about the cable, the cap and the rear periphery of the outer sheath, whereby the cap prevents ingress of any overmolding material into the sheath and the interior of the connector; and latch means, including resilient snap-latch on the dielectric outer sheath engageable with a latch shoulder on the conductive shield casing, operatively associated between the conductive shield casing and the dielectric outer sheath when the conductive shield casing with the dielectric body located therewithin is slid into a final position to hold the sheath on the casing when the dielectric boot is overmolded about the cable.

8. The electrical connector of claim 7 wherein said cap includes a circumferential groove for receiving a peripheral edge of the dielectric outer sheath.

9. The electrical connector of claim 7 wherein said conductive shield casing includes a portion extending rearwardly for clamping onto a shield at a front end of the cable.

10. A method of fabricating an electrical connector for an electrical cable including a plurality of conductors, comprising the steps of:

terminating the conductors to a plurality of terminals mounted in a dielectric connector body;

mounting a conductive shield casing substantially about portions of the dielectric body and at least the terminations between the terminals and the conductors;

sliding a dielectric outer sheath with an inner cavity having a rear open end, substantially about at least a rear portion of the conductive shield casing where the at least rear portion of the conductive shield casing is slid within the inner cavity;

fitting a cap about the cable, covering substantially entirely the rear periphery of the dielectric outer sheath and sealing the rear open end of the cavity;

latching the outer sheath to the conductive shield casing by resilient latching means when the conductive shield casing is slid through the rear open end of the cavity into a final position to hold the sheath on the casing; and overmolding a dielectric boot about the cable, the cap and the rear periphery of the outer sheath, with the cap preventing ingress of any overmolding material into the sheath and the interior of the connector.

11. The method of claim 10 wherein said cap is fitted about the cable prior to positioning the dielectric outer sheath, and the cap thereafter is moved forwardly against the rear periphery of the outer sheath prior to overmolding the boot.

* * * * *